US007324769B2

(12) United States Patent
Yamaoka

(10) Patent No.: US 7,324,769 B2
(45) Date of Patent: Jan. 29, 2008

(54) IMAGE FORMING APPARATUS HAVING A CHANGEABLE ADJUSTMENT TONER IMAGE POSITIONING FEATURE

(75) Inventor: Takahiko Yamaoka, Kashiwa (JP)

(73) Assignee: Canon Kabushiki Kaisha, Tokyo (JP)

( * ) Notice: Subject to any disclaimer, the term of this patent is extended or adjusted under 35 U.S.C. 154(b) by 169 days.

(21) Appl. No.: 11/396,509

(22) Filed: Apr. 4, 2006

(65) Prior Publication Data

US 2006/0233561 A1 Oct. 19, 2006

(30) Foreign Application Priority Data

Apr. 14, 2005 (JP) ..... 2005-117590

(51) Int. Cl.
*G03G 15/00* (2006.01)
*G03G 15/10* (2006.01)

(52) U.S. Cl. ..... 399/49; 399/60; 399/72

(58) Field of Classification Search ..... 399/49, 399/60, 72, 301, 302, 308, 312
See application file for complete search history.

(56) References Cited

U.S. PATENT DOCUMENTS 5,576,753 A 11/1996 Kataoka et al. ..... 347/248
5,940,114 A 8/1999 Kataoka et al. ..... 347/248
6,434,348 B1 * 8/2002 Tomizawa ..... 399/66
6,519,425 B2 * 2/2003 Fischer ..... 399/49
6,684,035 B2 * 1/2004 Furno et al. ..... 399/49

FOREIGN PATENT DOCUMENTS

JP 5-188783 7/1993
JP 6-51607 2/1994
JP 9-34243 2/1997
JP 10-31375 2/1998
JP 2000-318276 11/2000

* cited by examiner

*Primary Examiner*—Hoang Ngo
(74) *Attorney, Agent, or Firm*—Fitzpatrick, Cella, Harper & Scinto

(57) ABSTRACT

In an image forming apparatus in which an maximum image width for image forming is smaller than the sum of a maximum recording material width of a usable recording material and length of two pattern images for a density correction and a registration deviation correction in a recording material width direction, an area for forming the pattern image is changed between the case where the recording width of a practically usable recording material is not more than a threshold value and the case where the recording width exceeds the threshold value. When the recording width is not more than the threshold value, the pattern image is formed on a non-sheet passing section image area, and when the recording width exceeds the threshold value, the pattern image is formed on a sheet interval between the trailing edge of a proceeding recording material and the leading edge of a subsequent material.

15 Claims, 11 Drawing Sheets

IMAGE FORMING APPARATUS HAVING A CHANGEABLE ADJUSTMENT TONER IMAGE POSITIONING FEATURE

BACKGROUND OF THE INVENTION

1. Field of the Invention

The present invention relates to an image forming apparatus such as a printer, a copying machine and a facsimile which adjusts and controls a density correction, a registration deviation correction, a forcible consumption of toner or the like.

2. Description of the Related Art

In an image forming apparatus such as a printer, a copying machine and a facsimile, a toner image density and a registration deviation is corrected. In such correction, a pattern image (toner image) for measurement is formed on a photosensitive member or an intermediate transfer member, and the density and the position of this pattern image are detected. On the basis of the detected result, these corrections are made.

As such a detection method, conventionally, a method referred to as "patch check ATR (Auto Toner Replenishment" has been employed. In this patch check ATR, the pattern image is formed on the photosensitive member or the intermediate transfer member with toner and irradiated with light. The reflected light is read by a light detection unit such as a photodiode. Then, on the basis of the result of the reading, a toner replenishing unit is operated so as to maintain a toner density of a developer constant in a developing apparatus. This patch check ATR is a toner density detection method which utilizes characteristics of the toner. That is, optical properties of the toner image obtained by developing an electrostatic latent image depend on the toner density of the developer under a certain fixed electrostatic latent image condition.

Japanese Patent Application Laid-Open No. H5-333699 discusses adjustment control of a toner density correction. According to this document, a toner density of a developer in a developing apparatus and accordingly, a final image density is maintained constant. Further, Japanese Patent Application Laid-Open No. H6-51607 discusses adjustment control of a registration deviation correction. Japanese Patent Application Laid-Open No. H9-34243 discusses an example other than the above described type in which a pattern image is formed for adjustment control (adjusting toner image) without transferring to a recording material. This document describes the control under which toner is forcibly consumed to prevent a decrease in density and degradation of granularity in a low density part when an image having small toner consumption is continuously outputted. This control employs a method in which toner is forcibly consumed, and a high density toner image is formed on a photosensitive member or an intermediate transfer member. The used toner is disposed of into a waste toner containing unit or the like.

As timing for executing the adjustment control described above, there are various cases according to the purpose or the use of the adjustment such as at the time of turning the power of an image forming apparatus on, at the time of staring image forming, between sheet feeding (between recording materials) during continuous image forming, and at the time of completing the image forming. Generally, the more the adjustment control described above is executed, the more constant the toner density can be maintained. However, on the other hand, there are possibilities that printout time of a first sheet of the image forming apparatus is delayed or the throughput (productivity) is decreased.

In particular, when this adjustment control is executed between sheet feeding during continuous image forming, the number of recording materials on which the image is formed within a fixed time decreases. This effect is remarkable when the image is continuously formed on a large number of recording materials. That is, downtime accompanied with the adjustment control significantly lowers productivity and reduces usability. Therefore, there is a method in which, the adjustment control of the density is not executed when a density deviation is within a designed allowable range and a higher priority is given to the usability. In this method, only at predetermined timing, the adjustment control of the density is executed. In this case, when the predetermined timing is set directly before the density deviation exceeds the allowable range, a decrease in usability can mostly be prevented.

Adjustment control of the toner density correction, the registration deviation correction, and the forcible toner consumption is respectively essential control to perform stabilization of the image density, prevention of the position deviation and stabilization of granularity in the low density part, and further reduction in downtime has been required.

Among such methods, for the purpose of reducing downtime, there are also methods such as devising a shape of the pattern image, reducing an implementation frequency of the adjustment control between sheets. However, the downtime of the adjustment control is by no means eliminated.

On the other hand, according to a method discussed in Japanese Patent Application Laid-Open Nos. H10-31375 and H5-188783, a pattern image is formed on a non-sheet passing section (non-image forming section) parallel with a recording material conveyance area and an apparatus is adjusted in real time. That is, according to Japanese Patent Application Laid-Open No. H10-31375, the pattern image for detecting a density formed on the non-sheet passing section parallel with the recording material conveyance area is formed on the non-sheet passing section located at the end of a transfer roller. Density control is executed on the basis of the detected result of this pattern image. Further, according to Japanese Patent Application Laid-Open No. H5-188783, the pattern image for detecting a density is formed on the non-sheet passing section in a photosensitive member parallel with image forming. Density detection control and density correction control according to the detected result are executed simultaneously with the image forming.

However, if a configuration disclosed in Japanese Patent Application Laid-Open Nos. H10-31375 and H5-188783 is employed, when an image is formed on a recording material having a maximum sheet passing width, a space for forming the pattern image is required further outside the sheet passing width. Further, a deviation normally occurs within a tolerance in the sheet passing area. When the tolerance is taken into consideration, the pattern image has to be formed apart from a maximum sheet passing area at a predetermined interval. As a result, an apparatus becomes larger-sized. Such an increase of size in a direction of the sheet passing width causes a significant problem particularly in a low-speed and a medium-speed machines for which compactness is an important subject.

As described above, if a conveyance interval of the recording material is widened and the pattern image for the adjustment control is formed on an interval between sheets provided in a recording material conveyance direction, the downtime increases and the throughput reduces. On the other hand, if the pattern image for the adjustment control is formed outside the maximum sheet passing width and the pattern image is formed in a position parallel with the toner image that is to be formed on the recording material, reduction in throughput can be prevented. However, a size of the apparatus in a direction of the sheet passing width of the image forming apparatus increases.

SUMMARY OF THE INVENTION

The present invention is directed to an image forming apparatus configured to hold down an increase of an image forming area in a direction of a recording material width while preventing or reducing a delay of a print output caused by adjustment control of a toner density correction, a registration deviation correction, and a forcible consumption of toner or the like at predetermined timing.

The present invention is also directed to an image forming apparatus configured to hold down increase of an image forming area in a direction of a recording material width while preventing or reducing decrease of throughput (productivity) caused by adjustment control of a toner density correction, a registration deviation correction, and a forcible consumption of toner or the like.

Further, the present invention is directed to an image forming apparatus in which timing for forming an adjusting toner image can suitably be selected in response to a size of a recording material to be conveyed.

In one aspect of the present invention, an image forming apparatus includes an image bearing member, an image forming unit for forming a toner image on the image bearing member, a transfer unit for transferring the toner image formed on the image bearing member to a recording material, a detection unit for detecting an adjustment toner image formed by the image forming unit, an adjustment unit for adjusting the image forming condition of the image forming unit based on the detected result of the detection unit, a judgment unit for judging whether adjustment control by the adjustment unit is required, a control unit capable of executing a first mode for controlling image forming timing so as to form the adjustment toner image when the adjustment control was judged necessary in the judgment unit and to form a normal image after the formation of the adjusting toner image was completed during a period from reception of an image forming start signal to completion of image forming, and a second mode for controlling image forming timing so as to form the adjustment toner image in parallel with a normal image, and a selection unit which can select a first mode when a size of the recording material in a width direction orthogonal to a direction of conveyance of the recording material to which an image is transferred after the adjustment was judged necessary by the judgment unit, is larger than a predetermined threshold value, and a second mode when the size is smaller than the predetermined threshold value.

Further features of the present invention will become apparent from the following detailed description of exemplary embodiments with reference to the attached drawings.

BRIEF DESCRIPTION OF THE DRAWINGS

The accompanying drawings, which are incorporated in and constitute a part of the specification, illustrate exemplary embodiments of the invention and, together with the description, serve to explain the principles of the invention.

DETAILED DESCRIPTION OF THE INVENTION

Embodiments of the invention will be described in detail below with reference to the drawings.

First Embodiment

Figure 1:
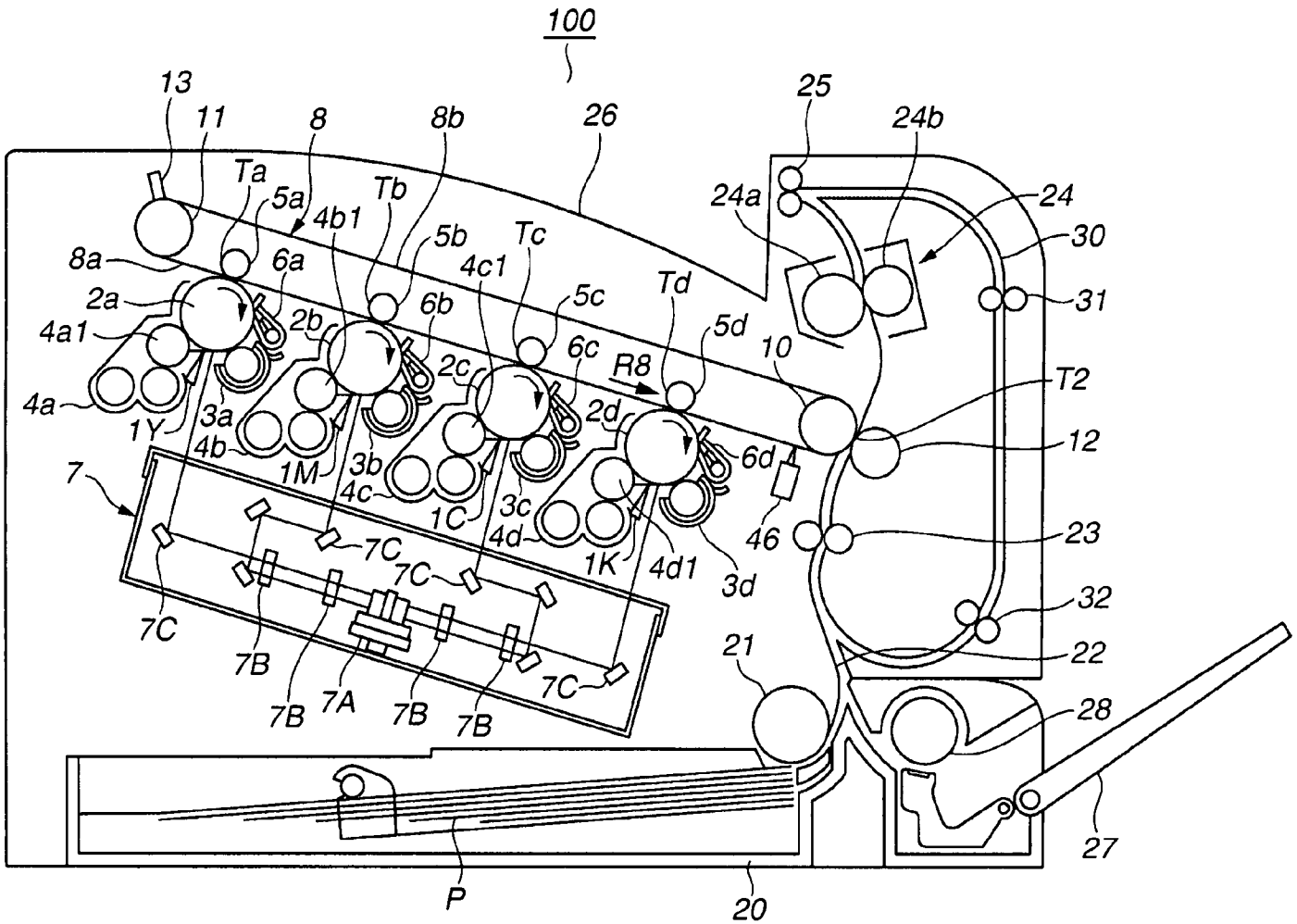
FIG. 1 is a diagram schematically showing a longitudinal section view of an image forming apparatus viewed from a front side according to the present invention.

FIG. 1 shows an image forming apparatus 100 according to the present invention. The image forming apparatus 100 shown in FIG. 1 is a full-four-color printer. FIG. 1 is a longitudinal section view showing a schematic configuration of a printer (hereinafter, referred to as "image forming apparatus") 100 viewed from a front side (from a user side position during use).

Referring to FIG. 1, a schematic configuration of the image forming apparatus 100 will be described.

The image forming apparatus 100 shown in FIG. 1 includes image forming sections 1Y, 1M, 1C and 1K which form four-color image forming sections (image forming unit). The four colors of toner image are yellow (Y), cyan (C), magenta (M) and black (K). These are placed in a line at a fixed interval apart from the upstream side to the downstream side along a moving direction (direction of an arrow R8) of an intermediate transfer belt 8 as described later.

In the respective image forming sections 1Y, 1M, 1C and 1K, drum-type electrophotographic photosensitive members (hereinafter, referred to as "photosensitive drum") 2*a*, 2*b*, 2*c* and 2*d* that are image bearing members (or an image forming units for forming an image on an intermediate transfer member to be described later) are rotationally disposed in an arrow direction (clockwise in FIG. 1). Around the respective photosensitive drums 2*a*, 2*b*, 2*c* and 2*d*, charging rollers 3*a*, 3*b*, 3*c* and 3*d* as a primary charging unit, developing apparatuses 4*a*, 4*b*, 4*c* and 4*d* as a developing unit, primary transfer rollers 5*a*, 5*b*, 5*c* and 5*d* as a primary transfer unit, and drum cleaners 6*a*, 6*b*, 6*c* and 6*d* are disposed almost in this order in a rotational direction. Further, below the developing apparatuses 4*a*, 4*b*, 4*c* and 4*d*, an exposure apparatus 7 is disposed. In the present exemplary embodiment, a latent image forming unit is configured by the photosensitive drums 2*a*, 2*b*, 2*c* and 2*d*, and the exposure apparatus 7. Above the photosensitive drums 2*a*, 2*b*, 2*c* and 2*d*, an intermediate transfer belt 8 as the intermediate transfer member or as the image bearing member is disposed. The intermediate transfer belt 8 is suspended over a secondary transfer opposed roller 10 and a tension roller 11. Outside the intermediate transfer belt 8, a secondary transfer roller 12 is disposed in a position corresponding to the secondary transfer opposed roller 10, and a belt cleaner 13 is disposed in a position corresponding to the tension roller 11.

Below the exposure apparatus 7, a sheet feeding cassette 20 containing a recording material P (a recording medium on which an image is formed, for example, a sheet or a transparent film) is disposed. Further, a sheet feeding roller 21, a conveyance path 22, a registration roller 23, a fixing apparatus 24, a sheet delivery roller 25 and a sheet delivery tray 26 are disposed almost substantially in this order, in a direction of conveyance of the recording material P, that is, from downward to upward. Furthermore, on the right side of the sheet feeding cassette 20, a freely opened and closed manual feeding tray 27 and a sheet feeding roller for manual feeding 28 are disposed, and on the right side of the fixing apparatus 24, a sheet re-feeding path 30 and sheet re-feeding rollers 31 and 32 are disposed. Also, a density sensor 46 serving as a density detection unit is disposed so as to face the surface of the intermediate transfer belt 8 (toner image transfer surface) on the downstream side of the image forming section 1K and on the upstream side of the secondary transfer roller 12 in a rotational direction (the direction of an arrow R8) of the intermediate transfer belt 8. In addition, the image forming apparatus shown in FIG. 1, includes a sheet passing width detection unit (not shown) for detecting a sheet passing width (recording material width) X (refer to FIG. 5) of the recording material P used for image forming. For the sheet passing width detection unit, for example, the sheet feeding cassette 20 containing the recording material P is provided with protrusions (not shown) in positions according to a size of the recording material. When the sheet feeding cassette 20 is mounted on an image forming apparatus main body (not shown), the image forming apparatus main body detects the position of the protrusion, thus the size of the recording material in the sheet feeding cassette 20 can be detected. Otherwise, users may input the size of the recording material to be used from an operation section 45 (refer to FIG. 2) of the image forming apparatus main body.

Subsequently, a detailed configuration of the above-described image forming apparatus 100 will be described.

In the present exemplary embodiment, the respective photosensitive drums 2*a*, 2*b*, 2*c* and 2*d* are provided with an OPC photosensitive layer having negatively electrified characteristics on the outer circumferential surface of a drum base made of aluminum. The photosensitive drums 2*a*, 2*b*, 2*c* and 2*d* are rotationally driven by a drive device (not shown) in an arrow direction at a predetermined process speed (peripheral speed).

The charging rollers 3*a*, 3*b*, 3*c* and 3*d* are disposed so as to come into contact with the photosensitive drums 2*a*, 2*b*, 2*c* and 2*d*. A charging bias is applied to the charging rollers 3*a*, 3*b*, 3*c* and 3*d* by a charging bias apply power source (not shown). Thus, the surface of the respective photosensitive drums 2*a*, 2*b*, 2*c* and 2*d* is uniformly charged at a predetermined polarity and potential.

The exposure apparatus 7 includes a laser emitting device (not shown) that emits light in response to a time-sequential digital electrical pixel signal of the image information. A laser beam emitted by the laser emitting device executes an exposure scan on the surface of the respective photosensitive drums 2*a*, 2*b*, 2*c* and 2*d*, by a polygon mirror 7A, a polygon lens 7B, a reflection mirror 7C or the like after the uniform charge. Thus, an electric charge at an exposure part is removed, and on the photosensitive drums 2*a*, 2*b*, 2*c* and 2*d*, an electrostatic latent image for each color is formed according to the image information.

The developing apparatuses 4*a*, 4*b*, 4*c* and 4*d* include developing sleeves 4*a*1, 4*b*1, 4*c*1 and 4*d*1 disposed so as to face the photosensitive drums 2*a*, 2*b*, 2*c* and 2*d*. A developing bias is applied to the developing sleeves 4*a*1, 4*b*1, 4*c*1 and 4*d*1 by a developing bias apply power source (not shown). Thus, the toner having each color is attached to the electrostatic latent image on the photosensitive drums 2*a*, 2*b*, 2*c* to be developed (visualized) as the toner image.

The primary transfer rollers 5*a*, 5*b*, 5*c* and 5*d* are disposed inside the intermediate transfer belt 8. The intermediate transfer belt 8 is endlessly formed by a dielectric resin such as polycarbonate, a poly(ethyleneterephthalate) resin film and a poly(vinylidene fluoride) resin. The intermediate transfer belt 8 is suspended between the secondary transfer opposed roller 10 and the tension roller 11 disposed diagonally upward from the secondary transfer opposed roller 10. The whole apparatus is configured to slant diagonally placing the secondary transfer opposed roller 10 in a lower position. This slant angle is set, for example, to be 15° to a horizontal plane.

In the intermediate transfer belt 8, a portion lower than a straight line, which connects the center of the secondary transfer opposed roller 10 with the center of the tension roller 11, serves as a transfer portion 8*a*, and a upper portion serves as a return portion 8*b*. In the transfer portion 8*a*, the back side is pressed toward the photosensitive drums 2*a*, 2*b*, 2*c* and 2*d* by the primary transfer rollers 5*a*, 5*b*, 5*c* and 5*d*. A primary transfer surface on the surface side abuts on the photosensitive drums 2*a*, 2*b*, 2*c* and 2*d*. Thus, between the photosensitive drums 2*a*, 2*b*, 2*c* and 2*d*, and the primary transfer surface, primary transfer parts (primary transfer nip part) Ta, Tb, Tc and Td are formed. A primary transfer bias is applied to the primary transfer rollers 5*a*, 5*b*, 5*c* and 5*d* by a primary transfer bias apply power source (not shown). Hence, the toner image on the photosensitive drums 2*a*, 2*b*, 2*c* and 2*d* is primarily transferred to the intermediate transfer belt 8 in turn in the primary transfer parts Ta, Tb, Tc and Td so that the toner image is superimposed on the intermediate transfer belt 8.

The secondary transfer roller 12 is disposed in a position corresponding to the secondary transfer opposed roller 10 outside the intermediate transfer belt 8. The secondary transfer roller 12 is configured to be attached detachably to the intermediate transfer belt 8. When the secondary transfer roller 12 abuts on the intermediate transfer belt 8, a secondary transfer part (secondary transfer nip part) T2 is formed between the secondary transfer roller 12 and the secondary transfer roller 12. A secondary transfer bias is applied to the secondary transfer roller 12 by a secondary transfer bias apply power source (not shown). Thus, the toner image on the intermediate transfer belt 8 is secondarily transferred to the recording material P by one operation in the secondary transfer part T2. (In this case, it is possible to view the intermediate transfer belt 8 as a first image bearing member and to view the recording material P as a second image bearing member.) Further, it is possible to view the primary transfer rollers 5*a*, 5*b*, 5*c* and 5*d*, the intermediate transfer belt 8, and the secondary transfer roller 12 as a transfer unit that performs image transfer to the recording material P.)

The toner (primary transfer remaining toner) that is not transferred to the intermediate transfer belt 8 during primary transfer, remains on the photosensitive drums 2A, 2B, 2C and 2D. The drum cleaners 6*a*, 6*b*, 6*c* and 6*d* for removing the remaining toner are disposed on the downstream side of the primary transfer parts Ta, Tb, Tc and Td in a rotational direction of the photosensitive drums 2*a*, 2*b*, 2*c* and 2*d*. Further, The toner (secondary transfer remaining toner) is not transferred to the recording material P, remaining on the intermediate transfer belt 8. The belt cleaner 13 for removing and recovering the remaining toner is disposed in the vicinity of the tension roller 11 outside the intermediate transfer belt 8. Rotation axes of the intermediate transfer belt 8, and the photosensitive drums 2*a*, 2*b*, 2*c* and 2*d* are mutually placed in parallel.

Next, the image forming operation of the image forming apparatus 100 configured as described above will be described.

When an image forming start signal is outputted, the photosensitive drums 2*a*, 2*b*, 2*c* and 2*d* of the respective image forming sections 1Y, 1M, 1C and 1K are rotationally driven in an arrow direction at a predetermined process speed, and uniformly charged at a predetermined potential of a negative polarity by the charging rollers 3*a*, 3*b*, 3*c* and 3*d*.

The electrostatic latent image is formed by the exposure apparatus 7 on the photosensitive drums 2*a*, 2*b*, 2*c* and 2*d* after charging. The exposure apparatus 7 emits a laser beam from a laser emitting device based on an image signal which is inputted from the exterior device and subjected to color separation. Then, the laser beam performs exposure on the respective photosensitive drums 2*a*, 2*b*, 2*c* and 2*d* scanning through a polygon mirror 7A, polygon lenses 7B, reflection mirrors 7C or the like, so that an electric charge at an exposure portion is removed, and an electrostatic latent image is formed.

Then, first, yellow toner is attached to the electrostatic latent image formed on the photosensitive drum 2A by the developing apparatus 4*a*. In the developing apparatus, a developing bias having the same polarity as the charging polarity (negative polarity) of the photosensitive drum 2*a* is applied to visualize a toner image. This yellow toner image is primarily transferred to the intermediate transfer belt 8 by the primary transfer roller 5*a* to which a primary transfer bias (positive polarity which is opposite to toner) is applied in the primary transfer part Ta. In the embodiment, the photosensitive drum 2*a*, the developing apparatus 4*a*, the primary transfer roller 5*a*, or the like also constitute a unit for forming an image on the intermediate transfer belt 8.

The intermediate transfer belt 8 to which the yellow toner image is transferred is moved to an image forming section 1M. Then, in the image forming section 1M, a magenta toner image formed on the photosensitive drum 2B same as described above, is superimposed on the yellow toner image on the intermediate transfer belt 8 and is primarily transferred in the primary transfer part Tb.

Thereafter, in the same manner, on the yellow and the magenta toner images superposed on and transferred to the intermediate transfer belt 8, a cyan and a black toner images formed by the photosensitive drums 2*c* and 2*d* of the image forming sections 1C and 1K are superimposed in turn in the primary transfer parts Tc and Td. Thus, the four-color toner image is superimposed on the intermediate transfer belt 8. In such a manner, the toner image is successively superimposed on the intermediate transfer belt 8, (i.e., the image bearing member), from a plurality of image forming units, thus the image can be formed.

At this time, primary transfer toner which is not transferred to the intermediate transfer belt 8, remains on the respective photosensitive drums 2*a*, 2*b*, 2*c* and 2*d*. This primary transfer remaining toner is scraped by the cleaning blade of the respective drum cleaners 6*a*, 6*b*, 6*c* and 6*d* and is recovered.

The tip of the four-color toner image superimposed on the intermediate transfer belt 8 arrives at a secondary transfer section T2 together with rotation in the direction of arrow R8 of the intermediate transfer belt 8. In timing with the arrival of the four-color toner image tip, a recording material P is fed by the sheet feeding roller 21 or the sheet feeding roller 28 from the sheet feeding cassette 20 or the manual feeding tray 27. The recording material P is conveyed to the resisting roller 23 through the conveyance path 22, and further, conveyed to the secondary transfer section T2 by the resisting roller 23. The secondary transfer bias having an opposite polarity (positive polarity) to the toner is applied to the secondary transfer roller 12, thus the four-color toner image on the intermediate transfer belt 8 is secondarily transferred by one operation on the recording material P that is conveyed to the secondary transfer section T2.

When the toner image is secondarily transferred, secondary transfer toner which is not transferred to the recording material P and remains on the intermediate transfer belt 8, is removed by the belt cleaner 13 and recovered.

On the other hand, the recording material P is conveyed to the fixing apparatus 24, after the toner image is secondarily transferred. The recording material P is heated and pressed when the recording material P is passed through the fixing nip part between a fixing roller 24*a* and a pressure roller 24*b*. Thus, the four-color toner image is fixed on the surface of the recording material P. The recording material P is delivered onto the sheet delivery tray 26 by the sheet delivery roller 25 after the toner image is fixed. Hence, the full-four-color image forming on the surface (one side) of the recording material P is completed.

The above-described operation is the image forming operation when the image is formed on one side (one-sided).

Subsequently, in the image forming apparatus 100, the image forming operation in which the image is formed on both sides (two-sided) will be described.

This operation is similar to the operation in which the image is formed on one side until the recording material P is conveyed to the fixing apparatus 24. The sheet delivery roller 25 reverses its direction of rotation immediately before the a trailing edge of the rerecording material P finishes passing through the sheet delivery roller 25. As a result, the recording material P, on which the four-color toner image is fixed, is introduced into the sheet re-feeding path 30 in a condition that the trailing edge is at the head and two sides of the recording material P are reversed. Thereafter, the recording material P is conveyed toward the resisting roller 23 by the sheet re-feeding rollers 31 and 32, and further conveyed to the secondary transfer section T2 by the registration roller 23. Until this time, in the same manner as described above, the four-color toner image is transferred onto the intermediate transfer belt 8. The toner image having these four colors is transferred onto the back side of the recording material P in the secondary transfer section T2, and fixed on the back side of the recording material P in the fixing apparatus 24. The recording material P, after the toner image is fixed, is delivered onto the sheet delivery tray 26 by the sheet delivery roller 25. Thus, the full-four-color image forming on both sides of a piece of the recording material P is completed.

Figure 2:
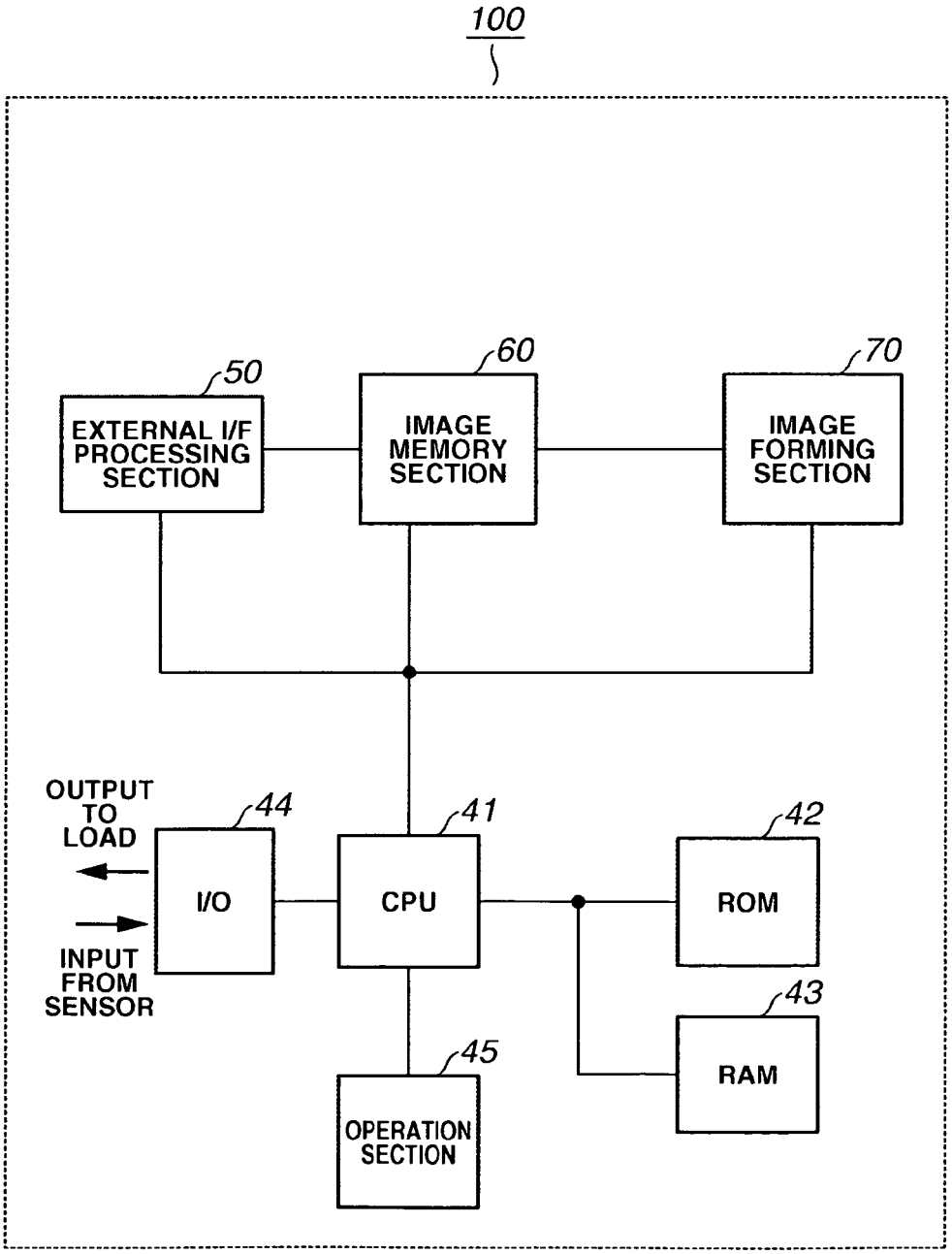
FIG. 2 is a block diagram showing the control of an image forming apparatus.

FIG. 2 shows a control block diagram of the image forming apparatus 100.

The image forming apparatus 100 includes a CPU (determination unit for determining whether to execute adjusting control by an adjusting unit, selection unit) 41 for executing the whole basic control. The CPU 41 is connected with a ROM 42 into which a control program is written, a RAM 43 for executing processing and an input and output port 44 by an address bus and a data bus. The input and output port 44 is connected with various loads (not shown) such as a motor and a clutch for controlling the image forming apparatus 100, a sensor for detecting the position of the recording material P or the like.

The CPU 41 controls input and output in turn through the input and output port 44 according to the contents of the ROM 42, and executes the image forming operation. Further, the CPU 41 controls a display unit of an operation section 45 (not shown) and a key inputting unit (not shown). Operators (users and service men) instruct the CPU 41 to execute an image forming operation mode and switch a display through the key inputting unit. The CPU 41 displays a condition of the image forming apparatus 100 and setting of the operation mode by the key inputting. The CPU 41 is connected with an external I/F processing section 50 which transmits and receives image data, processing data or the like from an external device 64 (refer to FIG. 4) such as a PC (personal computer) and a WS (work station). The CPU is also connected with an image memory section 60 and an image forming section 70. The image memory section 60 decompresses and temporarily stores the image. The image forming section 70 processes line image data transferred from the image memory section 60 so that the exposure apparatus 7 performs its exposure.

Figure 3:
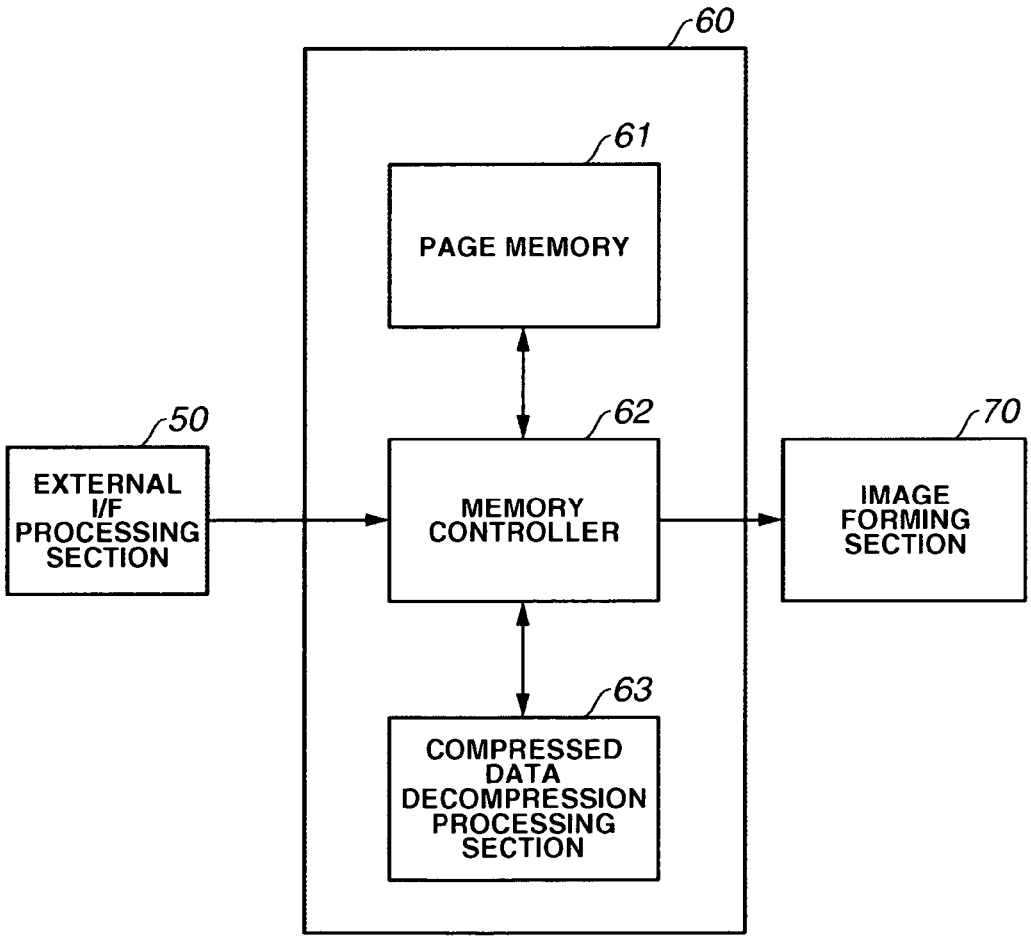
FIG. 3 is a block diagram showing an image memory section.

Referring to FIG. 3, the image memory section 60 will be described in detail. The image memory section 60 executes writing of image data received from the external I/F processing section 50 through a memory controller 62 into a page memory 61 configured by a memory such as a DRAM. The image memory section 60 also executes access to input and output of the image such as reading the image to the image forming section 70.

The memory controller 62 judges whether the image data from the external device 64 received from the external I/F processing section 50 are compressed data. If the image data is judged to be the compressed data, the memory controller 62 executes decompression processing using a compressed data decompression section 63, and then executes writing of the image data into the page memory 61. The memory controller 62 generates a DRAM refresh signal of the page memory 61, and arbitrates access to the page memory 61 with respect to writing from the external I/F processing section 50 and reading to the image forming section 70. Further, in accordance with a command of the CPU 41, the memory controller 62 controls a write address into the page memory 61, a read address from the page memory 61 and a read direction.

Figure 4:
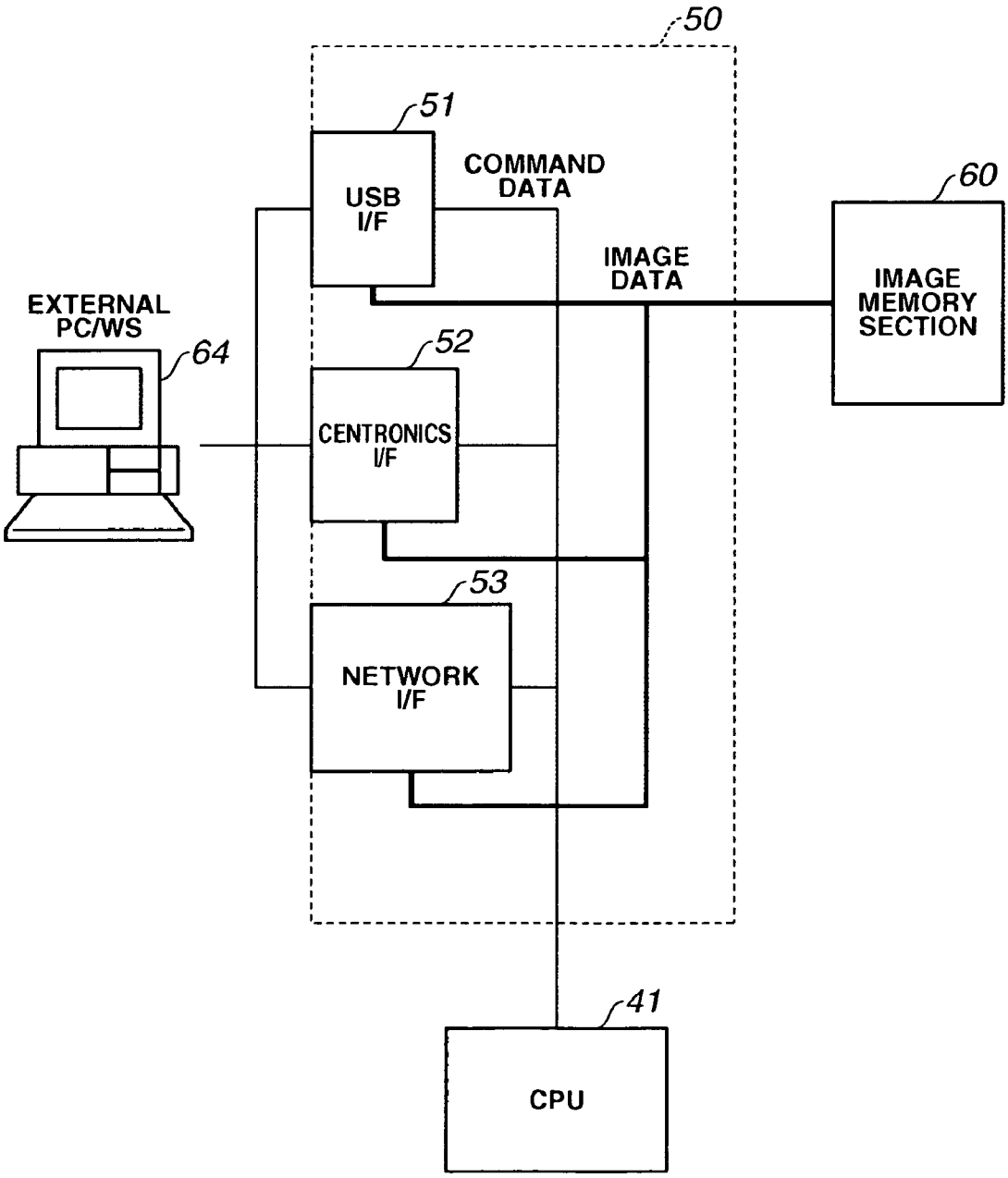
FIG. 4 is a block diagram showing an external interface (I/F) processing section.

Referring to FIG. 4, the configuration of the external I/F processing section 50 will be described. The external I/F processing section 50 receives image data and print command data transmitted from the external device 64 through either of a USB I/F 51, a centronics I/F 52 or a network I/F 53, and transmits status information on the image forming apparatus 100 judged in the CPU 41 to the external device 64. The print command data received from the external device 64 through either of the USB I/F 51, the centronics I/F 52 or the network I/F 53 are processed in the CPU 41, and generates timing and setting for executing print operation using the image forming section 70, the input and output port I/O 44 shown in FIG. 2 or the like. The image data received from the external device 64 through either of the USB I/F 51, the centronics I/F 52 or the network I/F 53 are transmitted to the image memory section 60 in response to the timing based on the print command data, and processed so as to form the image in the image forming section 70.

Next, adjustment control of a density correction and a registration deviation correction in the above-described image forming apparatus will be described in detail.

In the image forming apparatus, since a toner/carrier weight ratio contained in a developer changes due to repeated developing operation and replenishment of a developing device with toner, in order to grasp this change, a density detection mechanism is provided for detecting information corresponding to the toner/carrier weight ratio. The density sensor 46 (hereinafter, also referred to as a patch sensor) serves as a density detection unit and is disposed in front of the secondary transfer section T2. The density sensor 46 detects a density of a patch-like image developed for detecting the density (also referred to as adjusting toner image or patch) which is transferred to a predetermined position on the surface of the intermediate transfer belt 8.

Then, the toner/carrier weight ratio, that is, the amount of toner to be replenished, is controlled by the CPU 41 (FIG. 2) so as to maintain the density of the detected patch image constant.

Further, as another role of the density sensor 46, it detects the operation condition of a primary charger, an exposure apparatus, a developing device and a transfer charger. That is, the adjustment control of a primary charging bias, an exposure light quantity, a developing bias and a transfer bias are executed by the CPU 41 (so that the density of the patch image becomes a desirable value) on the basis of the detected result of the patch image density.

In the present invention, an image forming condition incorporated in the image forming unit (primary charger, exposure apparatus, developing device and transfer charger) represents control of at least one of the toner amount replenished to the developing device, and adjustment of the primary charging bias, the exposure light quantity, and the developing bias and the transfer bias.

Further, in the image forming apparatus, if a mechanical installation error between the respective photosensitive drums, an optical length error of each laser beam, change in optical path or the like is present, when the electrostatic latent image is formed on each photosensitive drum, and each color image is developed and transferred to a recording sheet on a transfer belt, the position of each color image becomes misaligned. In order to prevent the misalignment, the pattern image for the registration correction which is transferred on the intermediate transfer belt from the photosensitive drum is read by the density sensor 46, the position of a pattern for registration correction of each color is judged from a density value of the readout data, the registration deviation on the photosensitive drums corresponding to each color is detected on the basis of this position, an image signal required to be recorded is electrically corrected in response to a detected correction and/or the reflection mirrors 7C included in an optical path of the laser beam are driven to correct a change in the optical length or change in the optical path.

In the present invention, the adjustment toner image denotes the toner image formed in order to perform the adjustment control of the toner density correction, the registration deviation correction, the forcible consumption of toner or the like.

Figure 5:
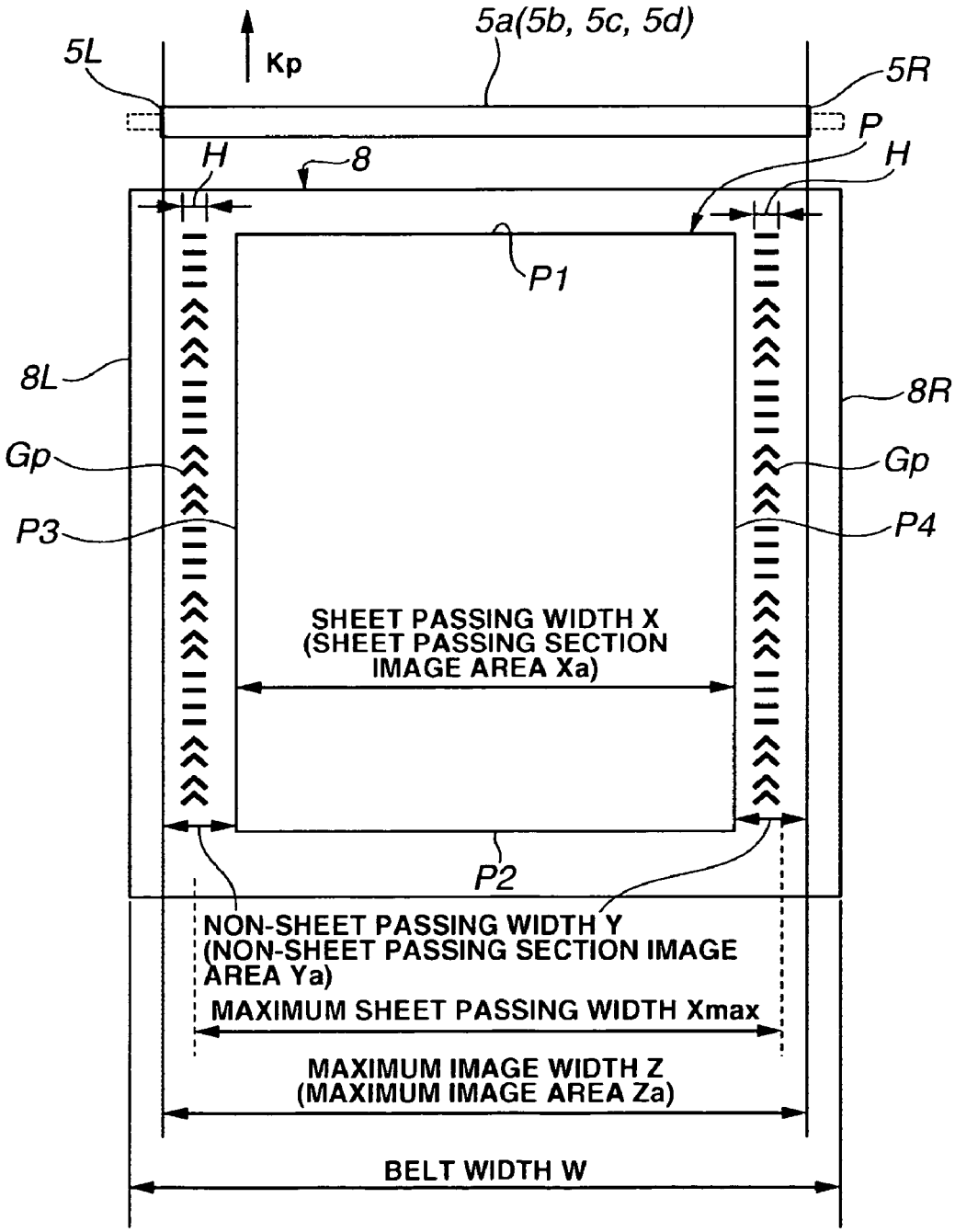
FIG. 5 is a diagram illustrating the relation of length in a direction of a sheet passing width among a recording material, a transfer roller and an intermediate transfer belt.

FIG. 5 schematically shows the relation of length with respect to the primary transfer rollers 5*a*, 5*b*, 5*c* and 5*d*, the intermediate transfer belt 8, and the recording material P in a direction of a sheet passing width (same as a thrust direction along the axis of the primary transfer rollers 5*a*, 5*b*, 5*c* and 5*d*) of the recording material. A case will be described as an example below in which the image is formed on the basis of the center of the sheet passing width of the recording material P, that is, the image formation is performed referring to the center.

An arrow Kp shown in FIG. 5 indicates a direction of conveyance of the recording material P and a rotational direction of the intermediate transfer belt 8. The intermediate transfer belt 8 is formed endlessly, as described above, and a distance between the left end 8L and the right end 8R is a belt width W. In the primary transfer rollers 5*a*, 5*b*, 5*c* and 5*d*, a distance between a portion 5L which slightly enters inside from the left end and a portion 5R which slightly enters inside from the right end is a maximum image width Z in which the image can be formed. In the present embodiment, the maximum image width Z falls into the center within the above-described belt width W. Within the area of the surface of the intermediate transfer belt 8, an area which corresponds to the maximum image width Z and extends over the whole periphery is a maximum image area Za. The image can not be formed outside the maximum image width Z.

The recording material P used for the image forming includes a leading edge P1, a trailing edge P2, a left end P3 and a right end P4. Within the area of the surface of the intermediate transfer belt 8, an area corresponding to the whole recording material P is a sheet passing section image area Xa. Thus, the width of this sheet passing section image area Xa is the same as a sheet passing width X which is the length of the leading edge P1 of the recording material P. The sheet passing section image area Xa is included in the maximum image area Za. That is, the sheet passing width X falls into the center within the maximum image width Z.

A non-sheet passing section image area Ya is formed outside the sheet passing width X and inside the maximum image width Z within the area of the surface of the intermediate transfer belt 8 having a left edge 8L and a right edge 8R. The non-sheet passing section image area Ya is circularly formed with a non-sheet passing width Y which is the width of the non-sheet passing section image area Ya, in vicinity of both the left and right ends of the intermediate transfer belt 8. The sheet passing section image area Xa described above is an area where a normal image that is to be transferred to the recording material P, is formed. On the other hand, the non-sheet passing section image area Ya is an area where a pattern image (adjusting toner image) Gp for adjustment control for example, a density correction or a registration deviation correction is formed. The pattern image Gp is not transferred to the recording material P. However, as will be described later, if the sheet passing width X of the recording material P is large, the pattern image cannot be formed on the non-sheet passing section image area Ya.

In the present embodiment, an area where the sheet passing section image area Xa and the non-sheet passing section image area Ya provided on both the left and right sides of the sheet passing section image area are combined together, corresponds to the maximum image area Za.

That is, with respect to the width in a sheet passing width direction, the double of the non-sheet passing width Y added to the sheet passing width X makes the maximum image width Z. In this embodiment, the sheet passing width X of the recording material P which is maximum within the recording material P used in the above-described image forming apparatus, is a maximum sheet passing width Xmax. This maximum sheet passing width Xmax falls into the center within the maximum image width Z.

The above-described relation of length is expressed as follows:

$$W>Z>Xmax>X$$

$$Z=X+2Y$$

Among these values, reference numerals W, Z and Xmax are a constant determined by the image forming apparatus to be used. On the other hand, the sheet passing width X changes according to the recording material P. The non-sheet passing width Y decreases as the sheet passing width X increases.

In the present invention, the pattern image Gp for adjustment control of a width H (including a margin) in a sheet passing direction is formed on the non-sheet passing section area Ya if possible. If it is impossible, the pattern image Gp is formed between sheets. As a result, in the image forming apparatus, decrease of throughput can be restricted and increase of apparatus size in the sheet passing direction can be prevented. This detail will be described below. In the image forming apparatus to which the present invention is applied, in a case where the image is formed using the recording material P having the maximum sheet passing width Xmax, the maximum image width Z is set to the extent that the pattern image cannot be formed on the non-sheet passing section area Ya. That is, the relation of length expressed by $Z<X<Xmax+2H$ is set. Accordingly, the maximum image width Z can be made smaller than the case in which the pattern image Gp for adjustment control is formed in a direction of the recording material conveyance having a maximum size. Thus, the apparatus can be miniaturized. In the present embodiment, the pattern image Gp for adjustment control is formed on both sides of the recording material. However, the recording material may be conveyed with reference to one side and the pattern image Gp may be formed only on the side of the recording material. In this case, the relation of length is expressed by $Z<Xmax+H$.

As described above, in order to execute the adjustment control of the density correction, the registration deviation correction or the like, the pattern image Gp for adjustment control is formed on the intermediate transfer belt 8. In this case, when an image is continuously formed (during a job continuously forming the image on a plurality of sheets), the throughput (productivity) decreases if the pattern image Gp is formed between the sheet passing areas of the recording material on the intermediate transfer belt 8 (an area corresponding to the sheet interval between the recording materials being conveyed, that is, an area corresponding to the interval between the trailing edge of the proceeding recording material P and the leading edge of the following recording material P subsequent to this). On the other hand, in order to form the pattern image Gp on a portion corresponding to the outside of the maximum sheet passing width Xmax of the recording material P on the intermediate transfer belt 8, it is necessary to lengthen a size of the image forming apparatus in a sheet passing width direction. Thus, the image forming apparatus can become large-sized according to the lengthened size.

Hence, in the present embodiment, the pattern image (including a margin) is formed at least in a position in which the pattern image is superimposed on the sheet passing width Xmax of the recording material having a maximum size and also in a position in which the pattern image is not superimposed on the conveyance area conveying the recording material having a predetermined size smaller than the maximum size. Thus, the image forming area can be made small to the extent that the pattern image is superimposed on the maximum sheet passing width Xmax, and the apparatus can be miniaturized. At the time of executing adjustment control, if the recording material having a maximum size is conveyed, the conveyance area is superimposed on the pattern image. Accordingly, the conveyance interval of the recording material is widened and the pattern image is formed between the recording material conveyance areas. On the other hand, when the recording material having a predetermined size smaller than the maximum size is conveyed, the conveyance area is not superimposed on the pattern image, and the pattern image can be formed on both sides of the recording material conveyance area. Thus, without widening the sheet interval, the decrease in throughput can be restricted. As described above, according to the present embodiment, productivity and miniaturization are compatible. That is, when the sheet passing width X is not more than a predetermined threshold value a, the pattern image Gp for adjustment control is formed on the non-sheet passing section image area Ya on both sides of the sheet passing area (area where normal image is formed). Further, when the sheet passing width X exceeds the threshold value a, the conveyance interval is widened and the pattern image is formed only on the portion (portion corresponding to the sheet interval) corresponding to an area before and after the sheet passing.

A detailed control algorithm for the adjustment control of the density correction, the registration deviation correction, the forcible consumption of toner or the like, for example, a correction method of an image density based on the detected result of a density or a correction method of a registration deviation based on the detected result of a deviation quantity, is described in detail in Japanese Patent Application Laid-Open Nos. H5-333699, H6-51607 and H9-34243, therefore, its description is omitted herein.

The adjustment control of the density correction, the registration deviation correction and the forcible consumption of toner which is the characteristic part of the present invention will be described in detail below.

Figure 6:
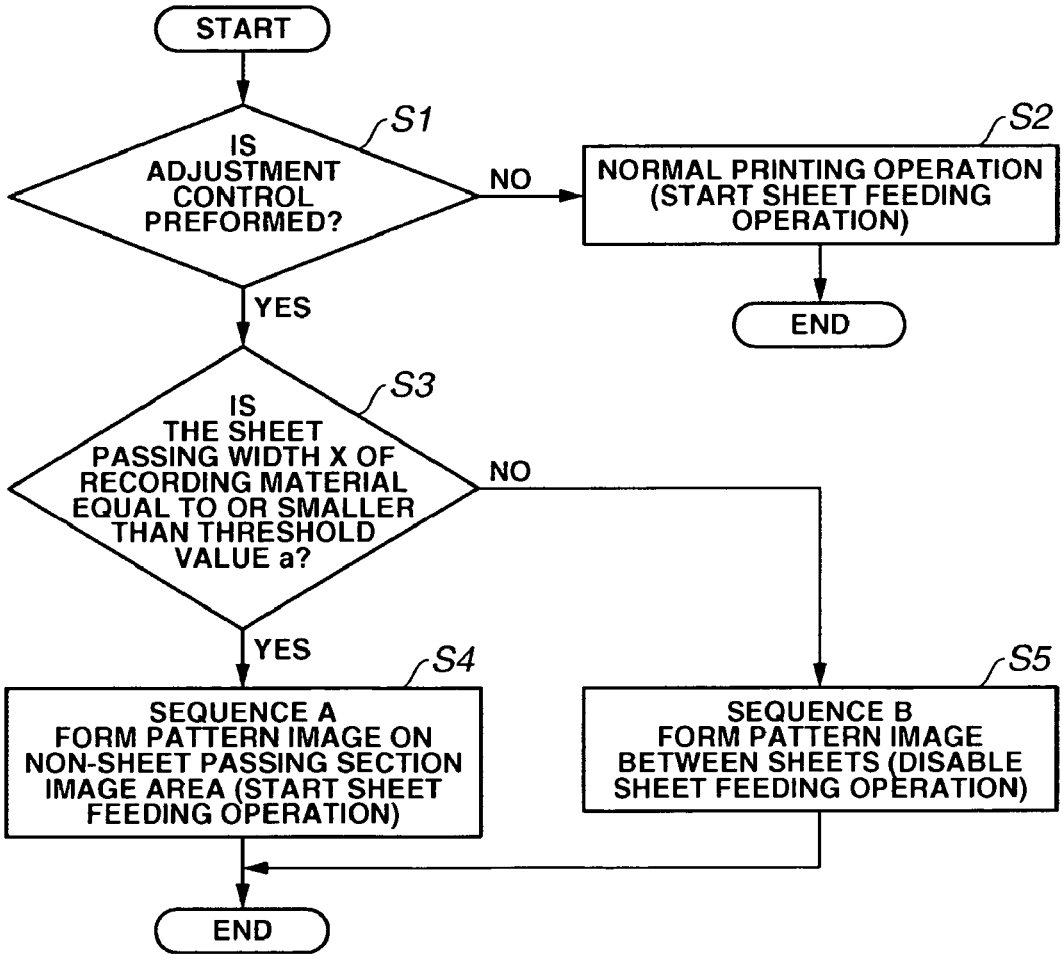
FIG. 6 is a flowchart showing flow for forming a pattern image according to the first exemplary embodiment.

FIG. 6 is a flowchart showing the algorithm for forming the pattern image for adjustment control. Reference numerals S1, S2 and others in the flowchart denote a number of a procedure (step).

The CPU 41 as a judgment unit judges whether execution of adjustment control is required when sheet is fed after image forming (print) starts (step S1). In the present invention, the start of the image forming means that an image forming start signal is generated and the CPU 41 starts operation toward formation of an image. The end of the image forming means the processing until the image that should be printed is formed on the image bearing member. A necessity to execute adjustment control can be judged, for example, on the basis of the accumulated number of printed sheets or the accumulated number of a video counter corresponding to an image density. When the accumulated number of printed sheets or the accumulated number of the video counter arrives at a predetermined value, the judgment is executed. In the present invention, timing to execute adjustment control is not particularly defined.

If the adjustment control is not required (No in the step S1), a normal printing operation (normal sequence) is executed (step S2). On the other hand, if the adjustment control is required (Yes in the step S1), the sheet passing width X is determined from the recording material P which should be printed, and it is determined whether the sheet passing width X is not more than a threshold value a (step S3). If the sheet passing width X exceeds the threshold value a (No in the step S3), the CPU 41 as a selection unit executes a sequence B (first mode: an interval-between-sheets mode which forms a pattern image on the area positioned before and after the conveyance area) (step S4). That is, in the first mode, the sheet feeding cannot be immediately started. Thus, the CPU 41 as a control unit for controlling the operation timing of the image forming unit and the conveyance timing of the recording material executes an operation of widening the sheet interval between the recording materials before the sheet feeding operation starts, and thereafter, the pattern image Gp for adjustment control is formed between sheets (step S5).

On the other hand, if the sheet passing width X is not more than the threshold value A (Yes in the step S3), the CPU 41 as the selection unit executes a sequence A (second mode: non-sheet-passing-width mode which forms the pattern image on the non-sheet passing section image area on both sides of the sheet passing area of the recording material), and at the same time starts the sheet feeding operation. That is, the pattern image Gp is formed outside the sheet passing width X in the recording material P (i.e. on the non-sheet passing section image area Ya shown in FIG. 5), and the normal image is simultaneously formed on the sheet passing section image area Xa. Here, the threshold value a of the sheet passing width X serving as a boundary can optionally be set depending on the type of the size of the recording material, the throughput of which should not be reduced. However, it is preferable to set a value as large as possible.

Figure 7A:
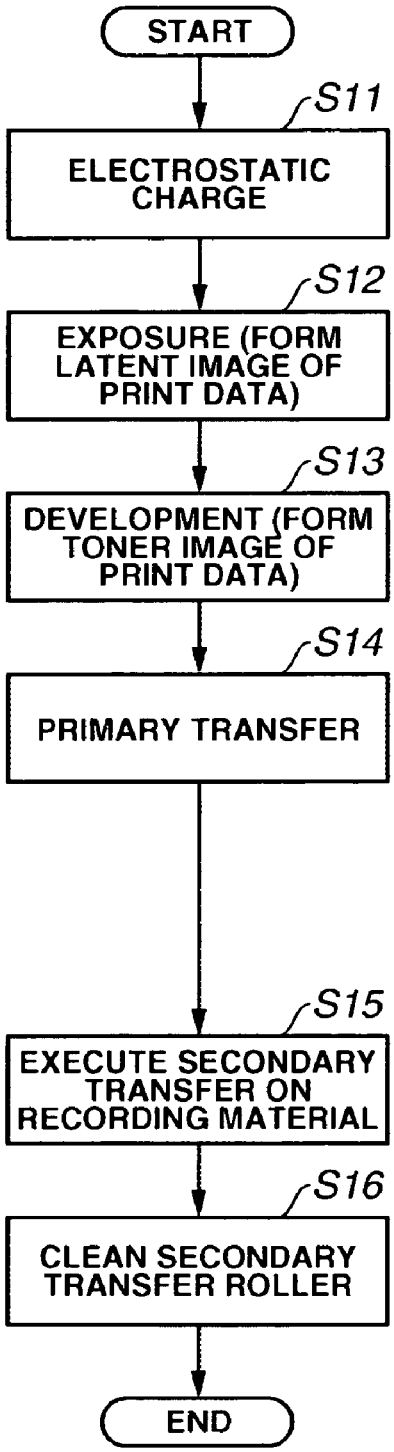
FIG. 7A is a flowchart showing the flow of image forming in a sheet passing section area in the flow of a sequence A shown in FIG. 6.
Figure 7B:
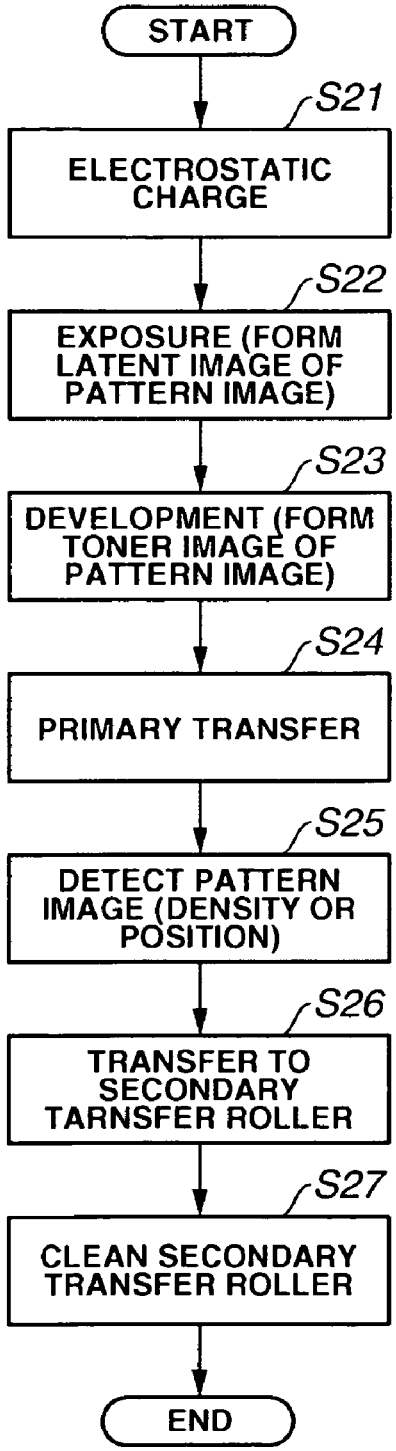
FIG. 7B is a flowchart showing the flow of image forming in a non-sheet passing section area in the flow of a sequence A shown in FIG. 6.

In FIGS. 7A and 7B, flowcharts are shown in terms of the sequence A (step S4) shown in FIG. 6. FIG. 7A shows an image forming sequence of the sheet passing section image area Xa when the pattern image Gp is formed during normal image forming. On the other hand, FIG. 7B shows an image forming sequence of the non-sheet passing section image area Ya when the pattern image Gp is formed during normal image forming. In two flowcharts shown in FIGS. 7A and 7B, steps described in a position having the same height, for example steps S11 and S21, or steps S15 and S26 are executed at the same timing.

In the steps S11 and S21, in either of the sheet passing section image area Xa and the non-sheet passing section image area Ya, the surface of the photosensitive drums 2*a*, 2*b*, 2*c* and 2*d* (refer to FIG. 1) is uniformly charged. Thereafter, in an area corresponding to the sheet passing section image area Xa, the electrostatic latent image according to image data for print is formed by exposure operation (step S12). On the other hand, in an area corresponding to the non-sheet passing section image area Ya, the electrostatic latent image corresponding to the pattern image Gp is formed by exposure operation (step S22). In this case, it is possible to possess the data of the pattern image Gp separately from the image data and synthesize these data. Also it is possible to process the data of the pattern image Gp as a part of the image data. In steps S13 and S23, the toner image (normal image) and the pattern image Gp of the print data are separately formed by developing. The normal image and the pattern image Gp on these photosensitive drums 2*a*, 2*b*, 2*c* and 2*d* are primarily transferred onto the intermediate transfer belt 8 (steps S14 and S24). That is, the normal image is primarily transferred to the sheet passing section image area Xa on the intermediate transfer belt 8, and the pattern image Gp is primarily transferred to the non-sheet passing section image area Ya on the intermediate transfer belt 8.

The normal image and the pattern image Gp primarily transferred onto the intermediate transfer belt 8 are conveyed in the same direction as the intermediate transfer belt 8 together with its rotation in the direction of arrow RB. Then, in timing with arrival of the pattern image Gp at an image density sensor 46 disposed in front of the secondary transfer section T2, the CPU 41 (refer to FIG. 2) lights a LED (not shown) for irradiation in the image density sensor 46. Light is irradiated from the LED for irradiation, in the image density sensor 46 and the light reflected at the pattern image is detected. Thus, the density or the position of the pattern image Gp is detected (step S25). On the basis of the detection result, the adjustment control of the density correction, the registration deviation correction and others are executed.

Thereafter, the normal image on the intermediate transfer belt 8 is secondarily transferred onto the recording material P in the secondary transfer section T2 (step S15 shown in FIG. 7A). On the other hand, the pattern image Gp on the intermediate transfer belt 8 is not transferred onto the recording material P but transferred onto the surface of the secondary transfer roller 12 in the secondary transfer section T2 (step S26). Subsequently, the secondary transfer roller 12 is cleaned (steps S16 and S27). After the normal images are all secondarily transferred onto the recording material P, voltage having an opposite polarity to the transfer process is applied to the secondary transfer roller 12. Thus, the toner on the secondary transfer roller 12 is transferred to the intermediate transfer belt 8 again. This toner is removed by the belt cleaner 13 and recovered into a waste toner recovery vessel (not shown).

In the following description, in order to remove toner transferred onto the secondary transfer roller 12, an opposite bias is applied to the secondary transfer roller 12. However, instead of this method, it is possible to provide a mechanism (not shown) of cleaning the secondary transfer roller 12 separately and remove the toner by the cleaning mechanism.

Figure 8:
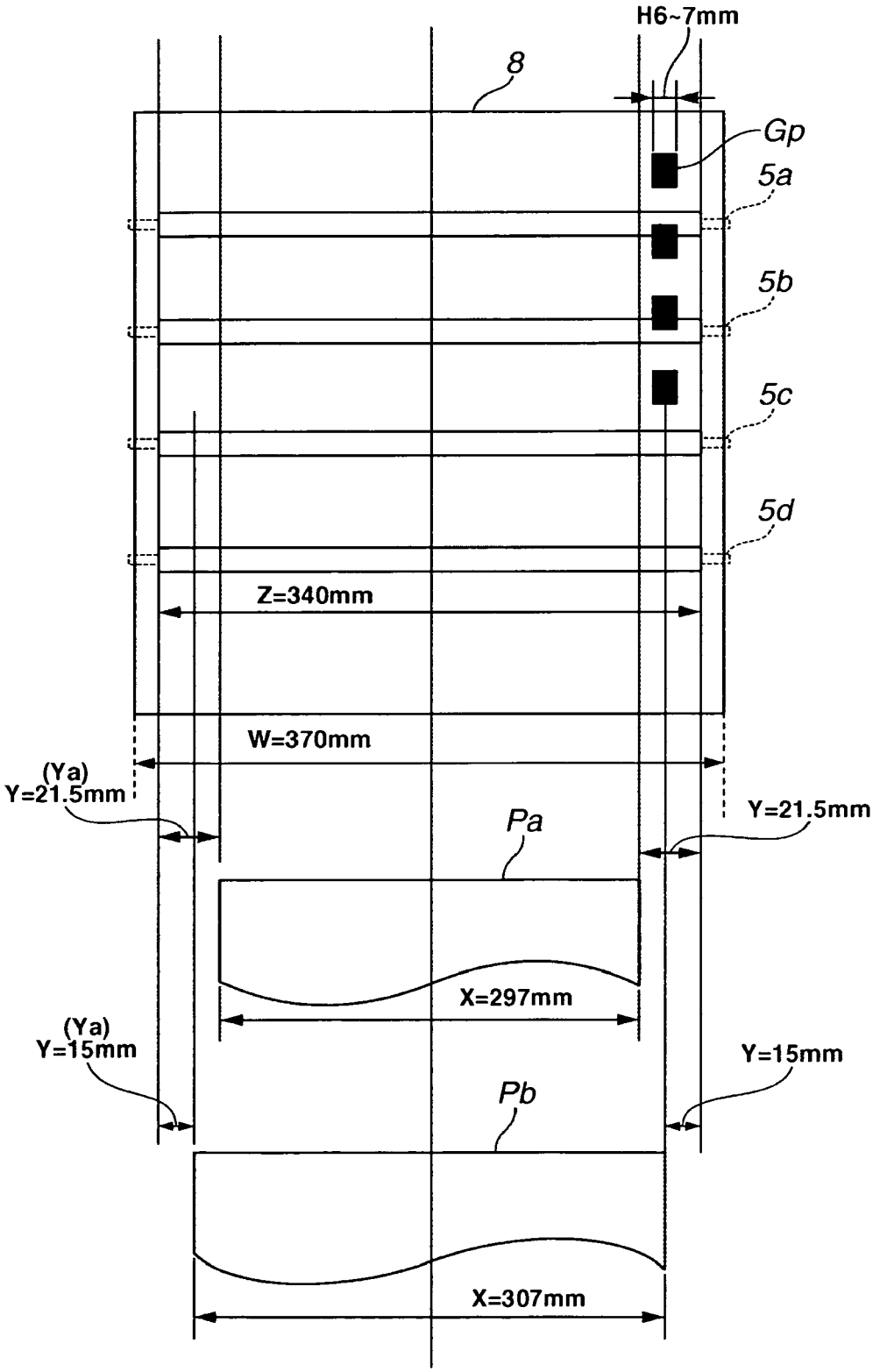
FIG. 8 is a diagram specifically showing the relation of length in a direction of a sheet passing width among a recording material, a transfer roller and an intermediate transfer belt.

The above-described sequence is the entire flow of the adjustment control. Referring to FIG. 8, more specific example will be described below, in which the threshold value a is set at 297 mm.

Figure 9:
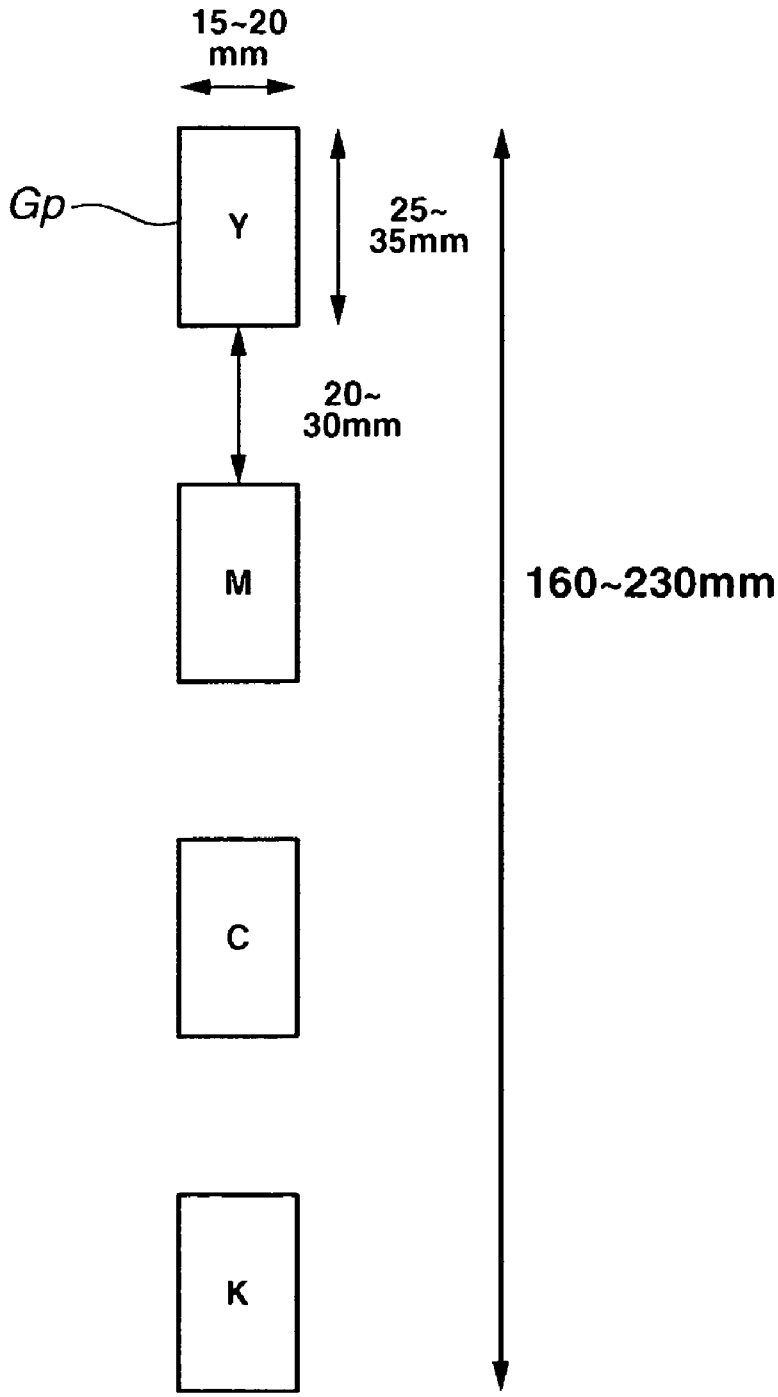
FIG. 9 is a diagram showing one example of a pattern image for a density correction.

A recording material Pa used in image forming is a horizontal-passing size A or a vertical-passing size A3, and in any case, the sheet passing width X is 297 mm. A recording material Pb (i.e., the sheet A3 having an extension width) will be described later. Also, a maximum image width Z is 340 mm, a belt width W is 370 mm and a non-sheet passing width Y calculated by Y=(Z−X)/2 is 21.5 mm. Accordingly, the pattern image Gp for a density correction (refer to FIG. 9) having a width H of 15 to 20 mm can be formed on the non-sheet passing section image area Ya. Namely, this example is a case in which the size A4 or the size A3 that is most frequently used, is selected as the size of the recording material P, of which the throughput should not be reduced.

As described above, in an example shown in FIG. 8, length of 327 to 337 mm which is obtained by adding the whole width of the pattern image Gp 2H of 30 to 40 mm to the sheet passing width X of 297 mm, is smaller than the maximum sheet passing width Z of 340 mm. Accordingly, the normal image is formed on the sheet passing section image area Xa, and the pattern image Gp can simultaneously be formed on the non-sheet passing section image area Ya.

Figure 10:
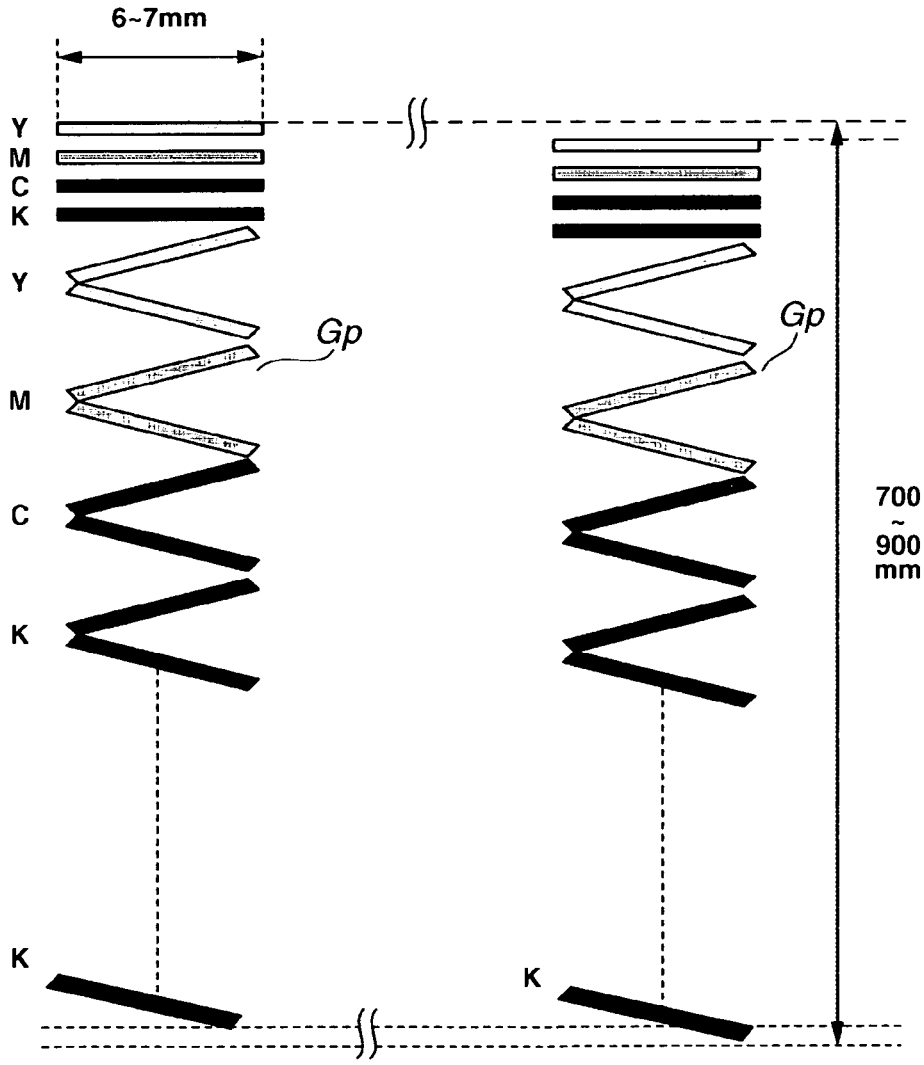
FIG. 10 is a diagram showing one example of a pattern image for a registration deviation correction.

In FIG. 5, when dimensions of reference numerals X, Y, Z and W are set the same as the case shown in FIG. 8, the pattern image Gp for the registration deviation correction (refer to FIG. 10) of a width H of 6 to 7 mm can be formed on the non-sheet passing section image area Ya as shown in FIG. 8.

FIG. 8 shows the recording material Pb of the size A3 having the extension width. This recording material Pb has a sheet passing width X of 307 mm. When an image is formed using this recording material Pb, the non-sheet passing width Y becomes 15 mm. Hence, the pattern image Gp for the registration correction having a width H of 6 to 7 mm shown in FIG. 10 can be formed within the non-sheet passing width Y. However, since the pattern image Gp for the density correction shown in FIG. 9 has a width H of 15 to 20 mm, the pattern image Gp having a width H of 16.5 mm can be formed within the non-sheet passing width Y by calculation. However, since a difference is small, namely 1.5 mm, when the pattern image Gp shifts in a sheet passing direction, there is concern that a part of the pattern image Gp is transferred onto the recording material Pb. Therefore, in the present embodiment, when the recording material P to be used is the recording material Pb of the size A3 having extension, both pattern images Gp for the density correction and the registration correction are formed between sheets. In this case, the threshold value a of the sheet passing width X may be set at 307 mm. When the recording material Pb of the size A3 having extension is used, for example, the pattern image Gp for the registration deviation correction having a narrow width H may be formed within the sheet passing width Y, and the pattern image Gp for the density correction having a wide width H may be formed between sheets. In this case, the value of the threshold value a may be changed in response to the width H of the pattern image. For example, the threshold value a may be set at 307 mm when the pattern image Gp for the registration deviation correction is formed, whereas the threshold value a may be set at 297 mm when the pattern image Gp for the density correction is formed. That is, it is not one fixed threshold value a that is set, but a plurality of values are set according to a value of the width H of the pattern image Gp to be formed.

In the above-described configuration, with respect to the horizontal-passing size A4 or the vertical-passing size A3 which is the most frequently used size of the recording material, a decrease in throughput can be restricted, that is caused by widening the conveyance interval and forming the pattern image on the area before and after the conveyance area corresponding to the sheet interval.

In the above description, the threshold value a of the sheet passing width X is set at 297 mm which is the sheet passing width when the size A4 is horizontally passed (or the size A3 is vertically passed). However, in the case where, for example, the width H of the pattern image Gp is larger than the example described above, or the maximum image width Z corresponding to the length of the primary transfer rollers 5*a*, 5*b*, 5*c* and 5*d* is short and a difference between the maximum image width Z and the sheet passing width X is small, 279 mm can be selected, for example, as the threshold value a which is the sheet passing width X when a letter-size sheet is horizontally conveyed.

Generally, the maximum sheet passing width Xmax in the image forming apparatus is longer than the sheet passing width X of the recording material P which is normally most frequently used among users. In the present embodiment, a restriction of decrease in throughput has been described concerning the most frequently used recording material P as an example. However, the selection of the threshold value a is not limited to the above-described value.

In the present embodiment, the image forming apparatus having the intermediate transfer belt 8 is described as the intermediate transfer member as an example. However, the present invention is not limited to this embodiment, but, for example, when the intermediate transfer drum is employed as the intermediate transfer member, the same control as above described can be executed and the same effect can be obtained. Further, in a configuration where the intermediate transfer member such as the intermediate transfer belt 8, or the intermediate transfer drum is not employed, the same control and effect can be achieved. That is, in the case where the toner image formed on the photosensitive drum serving as the image bearing member is directly transferred to the recording material, the same control and the same effect can be achieved. In this case, the threshold value a is set considering the relation between the maximum image width (maximum image area) where an image can be formed, in the image bearing member such as the photosensitive drum and the sheet passing width X, so that the same control can be executed. However, in this case, the image density sensor (not shown) for detecting the density and the position of the formed pattern image may be provided on the photosensitive drum, and the adjustment control may be executed according to the detected result.

As described above, according to the first embodiment, with respect to the area where the pattern image Gp for adjustment control is formed, when the sheet passing width X of the recording material P used in image forming is not more than the predetermined threshold value a, the pattern image is formed on the portion corresponding to the sheet interval provided before and after the sheet passing area of the recording material and also on the non-sheet passing section image area Yb on both sides of the sheet passing area. However, when the sheet passing width X exceeds the threshold value a, the pattern image is not formed on the non-sheet passing section image area Ya parallel with the conveyance area of the recording material but only on the portion corresponding to the sheet interval. Accordingly, a decrease in throughput is restricted and an increase in size of the image forming apparatus in the sheet passing direction is prevented, thus the image forming apparatus can be prevented from becoming large-sized. As the value of the threshold value a in this case, it is preferable to set a value as large as possible. Further, the threshold value a should be set to be not less than the sheet passing width X of the recording material P most frequently used in the image forming apparatus. In this case, the decrease in throughput can be restricted when the image is formed on the most frequently used recording material P, accordingly, its effect becomes great. In the present embodiment, the case has been described where the size of the recording material in the sheet passing direction enables to form the pattern image for adjustment control between the sheets, but the present invention is not limited to this example. When a pitch between sheets is narrow, the pattern image for adjustment control need not necessarily be formed between sheets.

Further, in the present embodiment, the case has been described in which the area for forming the pattern image is located in the position so as to be superimposed on the image forming area of the recording material having the maximum size (conveyance area of recording material having maximum size) so that miniaturization is achieved as one example. But the present invention is not limited to this example. For example, also in the case of forming the pattern image where the position for forming the pattern image and the image forming area of the recording material having the maximum size are not superimposed, the effect of the present invention can be obtained. That is, when the recording material having the maximum size (or the recording material having the larger size than the predetermined size) is conveyed, the pattern image may be formed only on the area corresponding to the sheet interval, and when the recording material having the size not more than the predetermined size, the pattern image may be formed at least on the non-image forming area section positioned in the direction orthogonal to the moving direction of the image forming area of the recording material.

That is, the pattern image may be formed where the position for forming the pattern image and the image forming area of the recording material having the maximum size are not superimposed. However, it is possible that the area corresponding to the tolerance cannot be secured when the recording material larger than the predetermined size is conveyed, in consideration of the variation (the tolerance) of the conveyance area in the direction orthogonal to the conveyance of the recording material, or the variation of the position for forming the pattern image. In such a case, if the recording material is not more than the predetermined size, the pattern image is formed on the area corresponding to the sheet interval and also on the non-image area positioned in the direction orthogonal to the moving direction of the image bearing member. Thus, productivity can be enhanced. On the other hand, if the recording material is larger than the predetermined size, the pattern image is formed only on the area corresponding to the sheet interval, thus the effect of the present invention can be achieved.

In the present invention, the superposition of the pattern image and the image forming area having the maximum size means that, in consideration of the tolerance of the pattern image forming position and the variation of the conveyance area of the recording material, the areas are not superimposed.

Furthermore, in the present embodiment, the recording material is conveyed with reference to a center and the pattern image is formed on the non-conveyance area on both sides in the orthogonal direction to conveyance of the recording material. But the present invention is not limited to this example, and the recording material may be conveyed with reference to one side. In addition, according to the present invention, if timing for forming the adjusting toner such as gradation control during job executing image formation arises, the apparatus can be made compact while suppressing down time due to the gradation control. In the present embodiment, a signal having the aim of executing the gradation control is generated by counting backward from timing required of the gradation control (timing in which if further image is formed, the gradation of the image becomes outside a designated allowable range). Then, control means forces to execute the gradation control based on the signal. That is, even if the signal having the aim of executing the gradation control executes the gradation control to form the image based on timing of generating this signal, the number of image formation is determined beforehand in which the gradation of the apparatus does not exceed the designated allowable range. Then, when the number of image formation arrives at the predetermined number which is set beforehand, the gradation control may be forced to be executed.

Second Embodiment

In a second embodiment, other than the pattern image for the density correction and the registration deviation correction, the adjustment control in the case of forming the toner image that is not transferred to the recording material P will be described.

The control for forcibly disposing toner will be described as one example. The control is performed for the purpose of preventing a decrease in image density, degradation of granularity in a low density area or the like when a low density image is continuously printed.

Figure 11A:
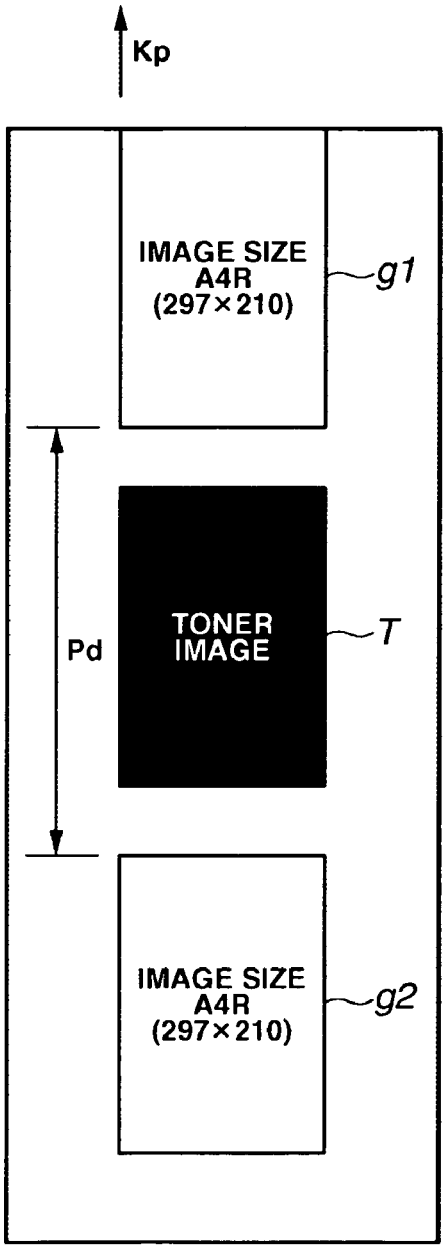
FIGS. 11A and 11B are diagrams illustrating the position of a toner image when the control of the forcible consumption of toner is executed.

FIG. 11A shows a case in which the toner image T is formed for forcibly disposing, on the sheet interval Pd between a recording material g1 of a vertical-passing size A4 and a recording material g2 of the vertical-passing size A4. In this case, since the sheet interval Pd is broadly taken, the throughput is reduced. FIG. 11A illustrates the toner image T in the same size as the recording materials g1 and g2. However, the size of the toner image T can optionally be controlled and selected.

On the other hand, FIG. 15 B shows the case in which the sheet interval Pd of the vertical-passing size A4 recording materials h1, h2 and h3 are not widened to form the toner image T on the non-sheet passing section image area Ya. Similarly to the adjustment control described in the first and second embodiments, other than the pattern image, the toner image T, which is conventionally formed on the sheet interval Pd and causes decrease in throughput, can be formed on the non-sheet passing section image area Ya as shown in FIG. 11B.

Figure 11B:
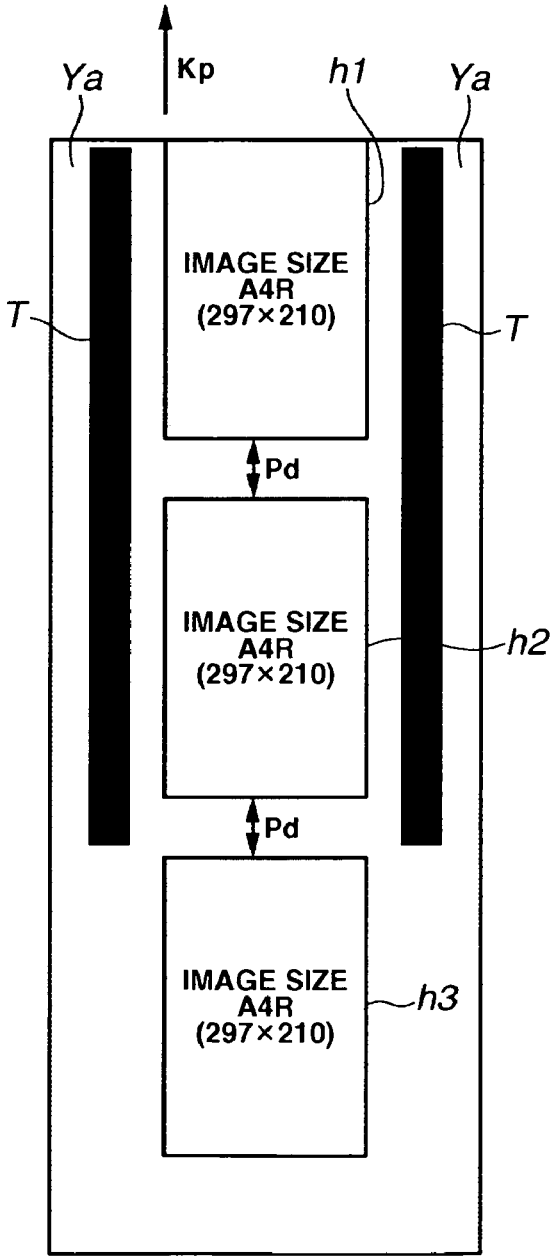

In the case of the toner image T shown in FIG. 11B, a large amount of toner is attached to the secondary transfer roller 12 (refer to FIG. 1) compared with the pattern image. In this case, it is possible to provide a cleaning mechanism (not shown) on the secondary transfer roller 12.

In the present embodiment, as an example of the control for forming the toner image on the photosensitive member or the intermediate transfer member, forcibly disposing of toner has been described. However, the present control can be applied to other adjustment control for forming the toner image that is not transferred to the recording material.

According to the above-described embodiment, it is possible to select whether the toner image for performing adjustment is formed on the non-sheet passing section area (outside area in a recording material width direction) parallel with the recording material conveyance area according to the size in the recording material width direction. Thus, the decrease in throughput can be restricted while the size of the image forming apparatus itself in the recording material width direction is prevented from becoming unnecessarily large.

While the present invention has been described with reference to exemplary embodiments, it is to be understood that the invention is not limited to the disclosed exemplary embodiments. The scope of the following claims is to be accorded the broadest interpretation so as to encompass all modifications, equivalent structures and functions.

This application claims priority from Japanese Patent Application No. 2005-117590 filed Apr. 14, 2005, which is hereby incorporated by reference herein in its entirety.

What is claimed is:

1. An image forming apparatus comprising:

an image bearing member;

an image forming unit for forming a toner image on the image bearing member;

a transfer unit for transferring the toner image formed on the image bearing member to a recording material;

a detection unit for detecting an adjustment toner image formed by the image forming unit;

an adjustment unit for adjusting an image forming condition of the image forming unit based on the detected result of the detection unit;

a determination unit for determining whether to execute the adjusting control by the adjustment unit;

a control unit configured to execute a first mode in which the image forming unit forms the adjusting toner image inbetween before and after the ordinary images in a moving direction of the image bearing member, when ordinary images are continuously formed on a plurality of recording materials, and a second mode in which the image forming unit forms the adjusting toner image and the ordinary images in parallel in a direction orthogonal to a conveyance direction of the image bearing member so that at least a part of the adjusting toner is superimposed on the ordinary image in the moving direction of the image bearing member, when ordinary images are continuously formed on a plurality of recording materials and;

a selection unit configured to select the first mode when a width in a direction orthogonal to a conveyance direction of the recording material to which the image formed on the image bearing member is transferred after it is determined to execute the adjusting control, is wider than the predetermined threshold, and select the second mode when a width in a direction orthogonal to a conveyance direction of the recording material is not wider than the predetermined threshold.

2. The image forming apparatus according to claim 1, wherein the width of an area within a maximum image forming area configured to form the image on the image bearing member by the image forming unit, and outside the conveyance area of the recording material having a maximum size is smaller than the adjustment toner image in a width direction orthogonal to a moving direction of the image bearing member.

3. The image forming apparatus according to claim 1, wherein the adjustment toner image is formed in a position where at least a part of the adjustment toner image is superimposed on an area corresponding to the conveyance area of the recording material having a maximum size, and also in a corresponding position outside the conveyance area of the recording material having a predetermined size smaller than the maximum size in a width direction orthogonal to a moving direction of the image bearing member.

4. The image forming apparatus according to claim 1, wherein the threshold value can be changed on the basis of a width size of the adjustment toner image.

5. The image forming apparatus according to claim 1, further comprising:

a detection unit for detecting the adjustment toner image, wherein an image forming condition is controlled on the basis of the detected result of the detection unit.

6. The image forming apparatus according to claim 5, wherein the detection unit comprises a density detection unit for detecting the density of the adjustment toner image, and wherein the adjustment unit adjusts the density of the toner image formed by the image forming unit based on the detected result.

7. The image forming apparatus according to claim 5, wherein the detection unit comprises a position detection unit for detecting the position of the adjustment toner image, and wherein the adjustment unit adjusts a position in which the toner image is formed, based on the detected result.

8. The image forming apparatus according to claim 1, wherein a conveyance interval of the recording material on which a normal image is formed when the second mode is executed, is narrower than when the first mode is executed, in the case of forming the adjustment toner image during a job for continuously forming the image on the recording material.

9. An image forming apparatus comprising:

an image bearing member;

an image forming unit for forming a toner image on the image bearing member, the image forming unit allowing formation of a waste toner image which is not transferred to a recording material and is forcibly disposed;

a transfer unit for transferring the toner image formed on the image bearing member to the recording material;

a removing unit for removing the waste toner image;

a judgment unit for judging whether formation of the waste toner image is necessary;

a control unit configured to execute a first mode for controlling image forming timing so as to form the waste toner image when the formation of the waste toner image was judged necessary in the judgment unit and to form a normal image after the formation of the waste toner image is completed during a period from reception of an image forming start signal to completion of image forming, and a second mode for controlling image forming timing so as to form the waste toner image in parallel with the normal image; and a selection unit which can select a first mode when a size of the recording material in a width direction orthogonal to a direction of conveyance of the recording material to which an image is transferred after the formation of the waste toner image is judged necessary, is larger than a predetermined threshold value, and a second mode when the size is smaller than the predetermined threshold value.

10. The image forming apparatus according to claim 9, wherein the width of an area within a maximum image forming area configured to form the image on the image bearing member by the image forming unit, and outside the conveyance area of the recording material having a maximum size is smaller than the adjustment toner image in a width direction orthogonal to a rotational direction of the image bearing member.

11. The image forming apparatus according to claim 10, wherein the width of an area within a maximum image forming area configured to form an image on the image bearing member by the image forming unit, and outside the conveyance area of the recording material having a maximum size in a width direction orthogonal to a rotational direction of the image bearing member is smaller than the width of the waste toner image.

12. The image forming apparatus according to claim 11, wherein the waste toner image is formed in a position where at least a part of the waste toner image is superimposed on an area corresponding to the conveyance area of the recording material having a maximum size, and in a corresponding position outside the conveyance area of the recording material having a predetermined size smaller than the maximum size in a width direction orthogonal to a rotational direction of the image bearing member.

13. An image forming apparatus comprising:

an image bearing member;

an image forming unit for forming a toner image on the image bearing member;

a transfer unit for transferring the toner image formed on the image bearing member to a recording material;

a detection unit for detecting an adjustment toner image formed by the image forming unit;

an adjustment unit for adjusting the image forming condition of the image forming unit based on the detected result of the detection unit;

wherein the image forming unit forms the adjusting toner image and the ordinary images in parallel in a direction orthogonal to a conveyance direction of the image bearing member so that at least a part of the adjusting toner is superimposed on the ordinary image in the moving direction of the image bearing member, when ordinary images are continuously formed on a plurality of recording materials that are equal to or less than the predetermined width; and wherein the image forming unit forms the adjusting toner image inbetween before and after the ordinary images in a moving direction of the image bearing member, when ordinary images are continuously formed on a plurality of recording materials which are wider than the predetermined width.

a control unit configured to execute a first mode for forming the adjustment toner image between the image forming areas of the first recording material and the second recording material by widening the conveyance interval between the first recording material and the subsequent second recording material when the adjustment toner image is formed after the image forming corresponding to the first recording material is made, and a second mode for controlling so as to form the adjustment toner image in parallel with the image forming of the second recording material during a job for continuously forming the image on a plurality of the recording materials; and a selection unit which can select a first mode when a width size of the second recording material orthogonal to a direction of conveyance of the second recording material is larger than a predetermined threshold value, and a second mode when a width size of the second recording material orthogonal to a direction of conveyance of the second recording material is smaller than the predetermined threshold value.

14. The image forming apparatus according to claim 13, wherein the width of an area within a maximum image forming area configured to form the image on the image bearing member by the image forming unit, and outside the conveyance area of the recording material having a maximum size is smaller than the adjustment toner image in a width direction orthogonal to a rotational direction of the image bearing member.

15. The image forming apparatus according to claim 13, wherein the adjustment toner image is formed in a position where at least a part of the adjustment toner image is superimposed on an area corresponding to the conveyance area of the recording material having a maximum size, and also a corresponding position outside the conveyance area of the recording material having a predetermined size smaller than the maximum size in a width direction orthogonal to a moving direction of the image bearing member.

* * * * *